US007988540B2

(12) United States Patent
Himmer

(10) Patent No.: US 7,988,540 B2
(45) Date of Patent: Aug. 2, 2011

(54) BRUSH MODULE FOR A GRINDING BRUSH

(75) Inventor: Nina Himmer, Moscow (RU)

(73) Assignee: Amanda Patent and Licensing SIA, Riga (LV)

( * ) Notice: Subject to any disclaimer, the term of this patent is extended or adjusted under 35 U.S.C. 154(b) by 0 days.

(21) Appl. No.: 12/656,554

(22) Filed: Feb. 3, 2010

(65) Prior Publication Data

US 2010/0144256 A1 Jun. 10, 2010

(51) Int. Cl.
*A22C 21/02* (2006.01)
*B24B 9/02* (2006.01)

(52) U.S. Cl. ..... 451/469; 15/230.12; 15/230.16; 15/230.19

(58) Field of Classification Search ..... 451/465, 451/178, 469, 496, 502, 466, 464, 490; 15/230.16, 15/97.3, 230.17, 230.15, 230.12, 230.14
See application file for complete search history.

(56) References Cited

U.S. PATENT DOCUMENTS

| | | | | |
|---|---|---|---|---|
| 5,396,680 | A * | 3/1995 | Belanger | 15/230.16 |
| 5,813,076 | A * | 9/1998 | Belanger et al. | 15/97.3 |
| 6,532,615 | B2 * | 3/2003 | Clark | 15/230.12 |
| 6,793,569 | B2 * | 9/2004 | Lundum | 451/490 |
| 7,195,553 | B2 * | 3/2007 | Knight | 452/93 |

* cited by examiner

*Primary Examiner* — Timothy V Eley
(74) *Attorney, Agent, or Firm* — Dykema Gossett PLLC

(57) ABSTRACT

A brush module (6) for a rotating grinding brush, said brush module comprising: an elongate body part (7); at least one abrasive cloth (9) protruding from the body part (7); a plurality of bristles (8) extending from the body part (7) essentially in the same direction as the abrasive cloth (9). The body part (7) is provided with an undercut, longitudinally extending guide (13), and at an edge the abrasive cloth (9) is provided with a protruding head (15) that is complementary with the undercut groove (13) to the effect that the undercut guide (13) and the protruding bead (15) constitute complementary mechanical interconnecting means for releasable mounting of the abrasive cloth (9) on the body part (7). The protruding bead (15) is provided on a holder (14) comprising two flaps (16, 17), between which an edge of the abrasive cloth (9) is securely clamped. Besides, use of such abrasive cloth (9) in a rotating grinding brush with or without brush module.

4 Claims, 2 Drawing Sheets

BRUSH MODULE FOR A GRINDING BRUSH

The invention relates to a brush module for a rotating grinding brush, which brush module comprises: an elongate body part, at least one abrasive cloth protruding from the body part, a plurality of bristles that protrude from the body part essentially in the same direction as the abrasive cloth; said body part being provided with an undercut, longitudinally extending guide; and the abrasive cloth being at an edge provided with a protruding bead that is complementary with the undercut guide, whereby the undercut guide and the protruding bead constitute complementary mechanical interconnecting means for releasable mounting of the abrasive cloth on the body part.

Moreover the invention relates to use of an abrasive cloth in a rotating grinding brush comprising at least one cylinder with rows of radially protruding bristles and, between these, rows of undercut, longitudinally extending guides that are complementary with a protruding bead at the edge of the abrasive cloth, whereby the undercut guides and the protruding bead constitute complementary mechanical coupling means for releasable mounting of the abrasive cloth on the grinding brush.

Today, rotating grinding brushes for grinding wooden elements are most often constructed from a hub provided with longitudinally extending grooves in which brush modules with abrasive cloth and brushes can be mounted by being displaced axially into the grooves. Each of these brush modules comprises a rail with fixedly mounted brushes and abrasive cloth, said rail fitting into the longitudinally extending grooves of the hub. The grooves are undercut; meaning that the brush modules are not expelled from the guides when the grinding brush rotates. This type of grinding brush is known eg from EP-A2-1 025 958. As a variety, the abrasive cloth is not fixedly mounted in the rail of the brush module; rather it is adhered thereto before the rail is mounted in one of the longitudinally extending grooves of the hub. This is advantageous, since the abrasive cloth is worn considerably faster than the brushes and is therefore to be exchanged much more frequently. However, it is a drawback of this product that the brush modules are to be dismounted from the hub before the worn-down abrasive cloth can be removed from the brush module and a new one be mounted. Then the brush modules are to be mounted on the hub again. Moreover, the abrasive cloth being glued onto the brush module, glue residues, if any, have to be removed prior to adhesion of the new abrasive cloth.

Exchange of the abrasive cloth thus being fairly time-consuming, the entire brush module with both brushes and abrasive cloth is most often exchanged in practice. This is inconvenient from several points of view. Firstly, it is a waste of resources to replace brushes that are only slightly worn and that further constitute a comparatively expensive part of the brush module if quality brushes are used. Secondly, it is often the case that, in order to save resources, the brush modules are exchanged later than they should. A worn-down grinding brush results in substantially poorer grinding and it may be difficult to obtain a satisfactory surface on the element.

Acknowledging this problem, brush modules have been developed, wherein the abrasive cloth is mounted to be releasable from the brush module, an edge of the abrasive cloth being wound for forming a bead that can be shifted into an undercut guide in the brush module (see Danish utility model No. DK 2003 00008 U3). However, the winding of a part of the abrasive cloth is associated with the drawback that it is difficult to control the production tolerances accurately. Besides, the surface of the wound bead is relatively soft, and both of these circumstances entail that it is relatively difficult to mount the abrasive cloths in the brush modules.

U.S. Pat. No. 2,804,730 also teaches brush modules wherein abrasive cloth can be mounted separately in a groove. Also in that case, the abrasive cloth is wound (around a rail), which poses the same problems as the configuration according to the above-referenced Danish utility model.

It is therefore the object of the invention to provide a brush module for a rotating grinding brush, whereby it is possible in an easy and expedient manner to replace the abrasive cloth while maintaining the brushes.

This is accomplished in that the protruding bead is provided on a holder that comprises two flaps, between which an edge of the abrasive cloth is mounted.

By providing the protruding bead on a separate holder, it is possible to manufacture it with precise tolerances, whereby mounting and dismounting of the abrasive cloth in the brush module is facilitated compared to the known replaceable abrasive cloths. Moreover, the abrasive cloth with bead is particularly simple and inexpensive to manufacture, which is a point of interest in view of the need for frequent exchange of that part.

The holder may be manufactured from any suitable material, but preferably it is manufactured from metal or plastics, whereby it is possible to manufacture a stable and smoothly sliding bead with flaps that can readily be tightened around an edge of the abrasive cloth.

The edge of the abrasive cloth is secured in the holder, either by the flaps tightening exclusively around the abrasive cloth, by application of glue between the flaps and the abrasive cloth, or by a combination of these methods. By all the methods it is possible to accomplish a very durable joint between the holder and the edge of the abrasive cloth.

The bristles can be exchangeable like the abrasive cloth, but since the bristles have a comparatively long longevity they are preferably fixedly mounted in the body part. Thereby the number of components in the brush module is reduced.

According to the preferred embodiment the brush module comprises a coupling part for interconnection with at least one hub in a grinding brush, said coupling part protruding from the body part in the direction opposite that of the abrasive cloth and the bristles. The protruding coupling part can be configured like the coupling part on the prior art brush modules, whereby the brush module according to the invention can be used in combination with known hubs.

As mentioned above, the invention also relates to use of an exchangeable abrasive cloth in connection with a grinding brush. Also in this context, it is the object to enable expedient replacement, and again this is accomplished in that the protruding bead of the abrasive cloth is provided on a holder that comprises two flaps, between which an edge of the abrasive cloth is mounted. By providing the protruding bead on a separate holder it is, as mentioned above, possible to manufacture it with accurate tolerances, whereby mounting and dismounting of the abrasive cloth in the grinding brush is facilitated compared to the known exchangeable abrasive cloths. Moreover the abrasive cloth with bead becomes particularly simple and inexpensive to manufacture, which is a point of interest in view of the need for frequent exchange of that part.

The bristles of the grinding brush may be fixedly mounted directly in the cylinder of the grinding brush, but according to a preferred embodiment the cylinder comprises a hub with a number of undercut, axially extending grooves, in which brush modules are mounted that are configured as indicated above.

According to a preferred embodiment of the use in accordance with the invention, a dismountable end plate is provided at least at the one end of the grinding brush, which end plate extends radially outwards past the axially extending grooves in the hub. Hereby it is ensured that the brush modules cannot be displaced axially out of the hub in operation.

Preferably the end plate is provided with indexation slots that can, by turning of the end plate, be aligned with the complementary interconnecting means between the brush module and the abrasive cloth. The indexation slots thus provide access to dismounting of the abrasive cloths without the brush modules having first to be dismounted from the hub. Hereby exchange of the abrasive cloths is facilitated considerably and it is made less time- and effort-consuming than is the case with the prior art grinding brushes. Such end plate with indexation slots can, of course, also be used if the bristles are fixedly mounted directly in the cylinder of the grinding brush; that is when brush modules are not used.

The invention will now be explained in further detail with reference to the drawing, wherein:

FIGS. 1*a* and 1*b* show the construction of a grinding brush according to the prior art;

FIGS. 2*a* and 2*b* show a brush module according to the invention;

Figure 1A:
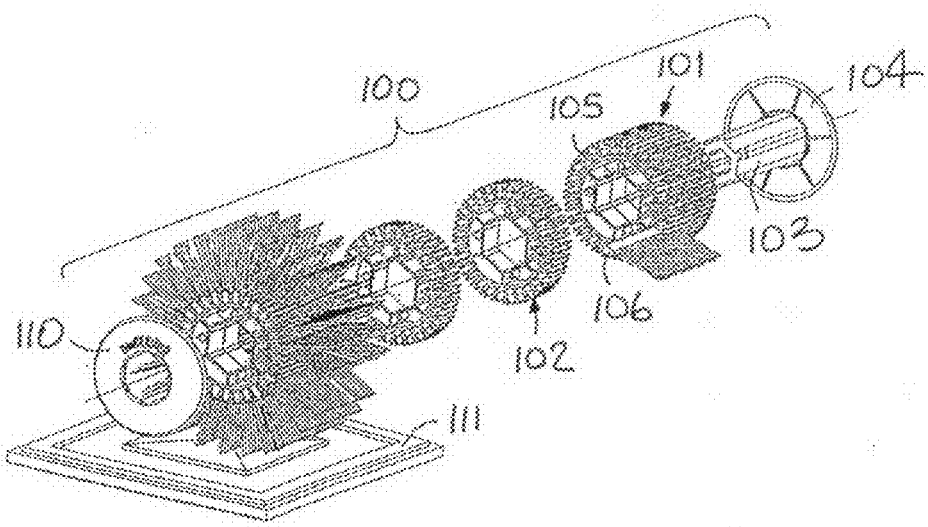
Fig. 1a (PRIOR ART)
Figure 1B:
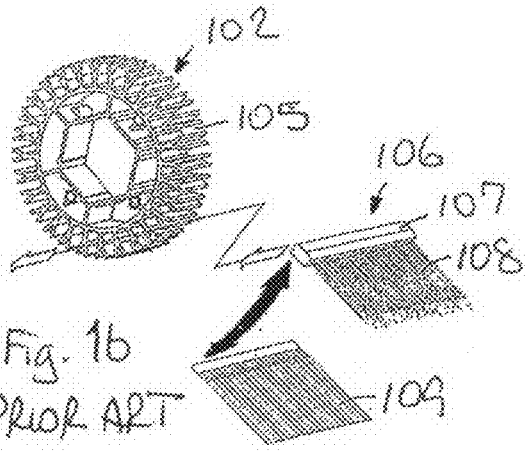
Fig. 1b (PRIOR ART)

In FIGS. 1*a* and 1*b* the construction of a grinding brush 100 according to the prior art is shown. The grinding brush 100 comprises a hub 101 being, in the shown example, composed of a number of separate hub discs 102. The hub discs 102 are mounted on a shaft 103 being, in the shown example, hexagonal to ensure a rotationally fixed coupling between the shaft 103 and the hub discs 102. At the one end the shaft 103 is provided with a fixed end plate 104. When the hub discs 102 are mounted on the shaft 103, the hub operates as a coherent unit being, along its entire circumference, provided with longitudinally extending grooves 105. The grooves 105 are undercut, ie they have the largest width at the bottom, most proximate to the centre, while narrower at the outer side of the hub 101.

When the hub 101 is mounted on the shaft 103, a number of brush modules 106 are displaced into the longitudinally extending grooves 105 as outlined in FIG. 1*b* and a shown in part to the right in FIG. 1*a*. The brush modules 106 comprise a body part 107 of plastics, from where the bristles 108 protrude. A piece of abrasive cloth 109 is adhered to the side of the body part 107 as outlined in FIG. 1*b* before the entire unit—the brush module 106—is mounted in the longitudinally extending grooves 105 of the hub 101. The adhesion is performed by means of a strip of double-coated tape arranged between the adhesive cloth 109 and the body part 107. The unit constituted by the hub (101) and the brush modules 106 constitutes the cylinder of the grinding brush, from where bristles 108 and abrasive cloth 109 protrude radially.

The number of brush modules 106 corresponds to the number of longitudinally extending grooves 105 in the hub 101, whereby all grooves 105 are filled. If the grooves are longer than the brush modules 106, more brush modules 106 are mounted in succession in each groove 105. Thus, from each groove 105, a number of bristles 108 and an abrasive cloth 109 radiate radially. Finally an end plate 110 is mounted that has such large radial expanse that the openings of the grooves 105 at the end of the hub 101 are covered thereby. Hereby it is prevented in a simple manner that the brush modules 106 are displaced out of the longitudinally extending grooves 105 of the hub 101.

The abrasive cloth 109 being the element to perform the grinding of an element 111, while the bristles 108 contribute merely by applying a pressure force onto the back of the abrasive cloth 109, the abrasive cloth 109 is slightly longer than the bristles 108. However, in use the abrasive cloth 109 is worn and shortens. To ensure optimal grinding the abrasive cloth 109 should therefore be exchanged before it becomes so short that the bristles 108 obtain contact with the element 111. Should it happen, the bristles 108 will also be worn simultaneously with the grinding performance being considerably reduced. In that case it is necessary to exchange both abrasive cloth 109 and bristles 108, ie exchange of the entire brush module 106.

However, the abrasive cloth 109 constituting far the least expensive part of the brush module 106, it is desirable to change only that. To a certain extent this is enabled by the abrasive cloth 109 being adhered to the body part 107 of the brush module 106. It is thus possible—at least theoretically—to dismount the abrasive cloth 109 from the body part 107 when the brush module 106 is dismounted from the hub 101, and to mount a new piece of abrasive cloth 109. In order for the operation to succeed, it is necessary to clean the body part 107 before the new piece of abrasive cloth 109 is adhered. Thus exchange of abrasive cloth 109 is both time- and effort-intensive, and the result is often that the entire brush module 106 is exchanged, even through, strictly speaking, it is not necessary.

Figure 2A:
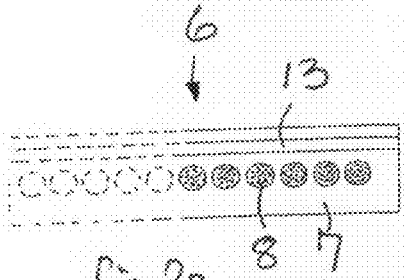
Figure 2B:
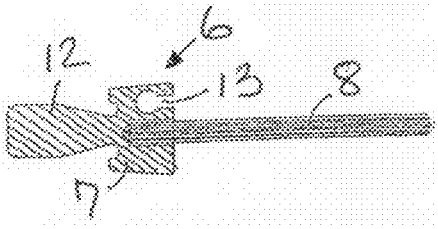

By the present invention this problem is encountered. FIGS. 2*a* and 2*b* show a brush module 6 according to an embodiment of the invention. In FIG. 2*a*, the brush module 6 is shown radially from the outside, the view being taken downwards along the bristles 8, while FIG. 2*b* shows a cross sectional view of the brush module 6. The dotted left part of the brush module 6 shown in FIG. 2*a* merely illustrates that the length of the brush module 6 can, of course, be adapted to any given situation. The bristles 8 are mounted in the body part 7 of the brush module 6, and in practice, they will radiate slightly from the point of attachment in the body part 7. For the sake of clarity, however, the view in FIG. 2*a* is such that the bristles 8 form cylindrical batches of bristles. The bristles 8 can be mounted in the body part 7 in any known manner.

Apart from being provided with bores for attachment of bristles, the body part 7 of the brush module 6 is also provided with a coupling part 12 that protrudes from the body part 7 in the direction opposite that of the bristles 8. The coupling part 12 is configured such that it fits into the grooves 105 of the known hubs 101 (see FIGS. 1*a* and 1*b*). Thus the brush module 6 can be mounted on the prior art hubs 101 by displacement of the coupling part 12 axially into grooves 105 on the hub 101 as described above with reference to the prior art. If a hub is used having differently configured grooves, the coupling part 12 will, of course, also be configured differently.

Figure 3:
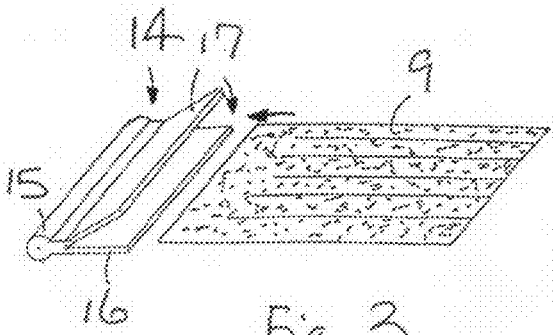
FIG. 3 is a perspective view of a holder for abrasive cloth.

Moreover, the body part 7 is configured with an undercut, longitudinally extending guide 13 for receiving a piece of abrasive cloth 9 mounted on a holder 14 (see FIG. 3). The abrasive cloth 9 can be of any current type and may comprise sanding grains mounted on cloth as well as on paper. Preferably the abrasive cloth is slit into thin strips as shown in order to thereby ensure the most flexible grinding possible.

At the one end the holder 14 has a protruding bead 15 that is configured complementarily with the guide 13 in the body part 7 of the brush module 6. At the opposite end two V-shaped flaps 16, 17 are provided. When the abrasive cloth 9 is mounted in the holder, the edge thereof is arranged between the two flaps 16, 17 that are subsequently pressed against each other and clamp the abrasive cloth 9 there between. This will appear from FIG. 4, which shows a hub 101 provided with a number of brush modules 6 of the type shown in FIGS. 2*a* and 2*b* with abrasive cloth 9 mounted thereon. The bristles 8 and the abrasive cloth 9 is shown only in connection with three of the brush modules, but of course it will be understood that usually all brush modules will be equipped with bristles 8 and abrasive cloth 9. The unit constituted by the hub (101) and the brush modules 6 constitute the cylinder of the grinding brush, from where bristles 8 and abrasive cloth 9 protrude radially.

Figure 4:
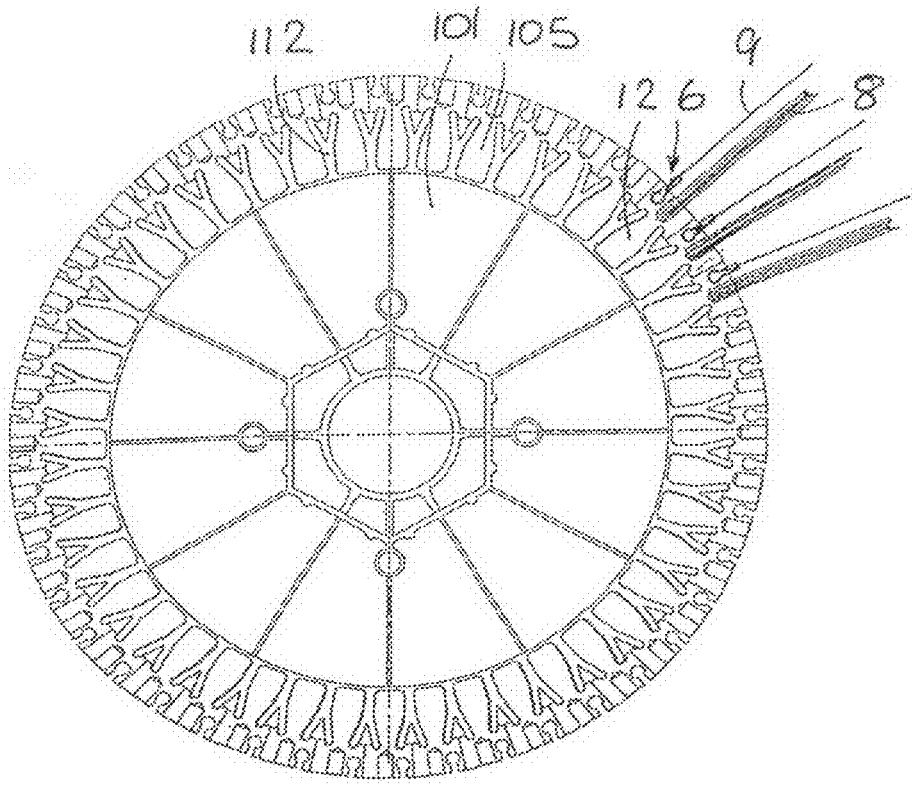
FIG. 4 is a hub provided with a number of brush modules of the type shown in FIGS. 2*a* and 2*b*.

As will appear from FIG. 4, the brush modules 6 abut on each other beyond the hub 101 as such. This means that the radial walls 112 between the longitudinally extending grooves 105 in the hub 101 cannot be pressed sideways, and there is thus no risk of the brush modules 6 be flung out of its engagement with the hub 101, when the grinding brush rotates.

Figure 5A:
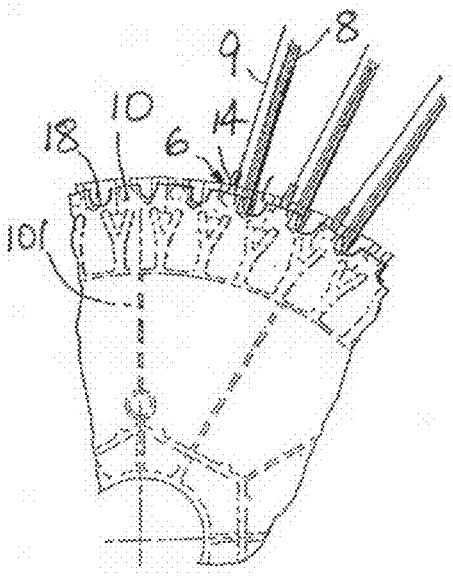
FIGS. 5*a* and 5*b* are large scale views of the disclosures of FIG. 4, featuring an end disc with indexation slots.

In an enlarged scale, FIG. 5*a* shows a section of the grinding brush shown in FIG. 4, wherein, however, the end of the hub 101 is covered by en end disc 10, corresponding to the end disc 110 shown in FIG. 1*a*. The end disc 10 is shown in its operating position, where it extends radially beyond the hub 101, which is outlined by dotted lines, and partially beyond the body parts 7 of the brush modules 6. Hereby it is ensured in a simple manner that the brush modules 6 are not displaced axially in relation to the hub 101. It is noted that in this position the end disc 10 also extends beyond the undercut guides 13 of the brush modules 6, in which guides the holders 14 of the abrasive cloths 9 are inserted. Hereby it is ensured that the abrasive cloth 9 cannot be displaced axially relative to the hub 101, either.

Figure 5B:
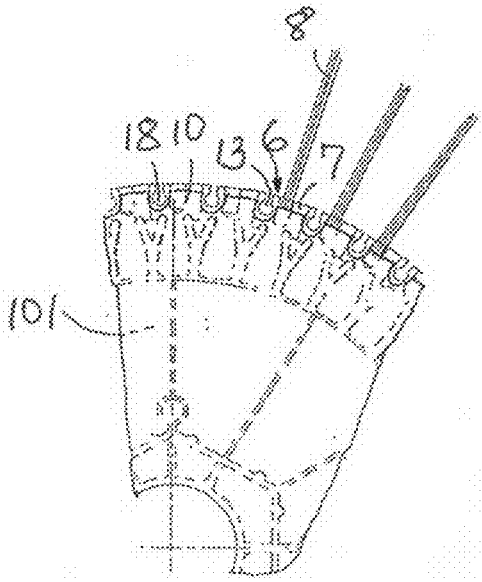

The periphery of the end disc 10 is provided with indexation slots 18, the object of which will appear clearly from FIG. 5*b*. It is shown that the end disc 10 is rotated slightly from the operating position shown in FIG. 5*a* to a position in which it is possible to replace the abrasive cloths 9 without having to initially dismount the brush modules from the hub 101. As it is, in this turned position the indexation slots 18 are aligned with the undercut guides 13 in the brush modules 6. The indexation slots 18 also having a width that exceeds the width of the guides 13 it is possible, in this position of the end disc 10, to dismount the abrasive cloths 9, merely by displacing them axially out of the guides 13 and past the end disc 10. By configuring the end disc 10 in this manner the need for dismounting the brush modules 6 from the 101 to replace the worn abrasive cloths 9 is eliminated.

The invention was described with reference to a preferred embodiment of both the brush module and of the use of an abrasive cloth in a grinding brush. However, several constructive details can be varied within the framework provided by the invention. For instance, the body part of the brush module can be configured such that it fits directly into the longitudinally extending grooves of the hub. Hereby the need for a protruding coupling part is obviated.

With regard to choice of material for the individual parts of the brush module and the grinding brush, several options are available. The brush module as such will typically be manufactured from extruded aluminium or plastics such that, in principle, it is possible to manufacture it in an endless length that can be cut off as desired. The holder for the abrasive cloth can be manufactured from an inexpensive metal or plastics material, its longevity being in all circumstances limited. As described above, the abrasive cloth can be secured by being securely clamped between the flaps 16, 17 alone, but it is also an option, however, to apply glue between the abrasive cloth 9 and the flaps 16, 17. Optionally a combination of clamping and glue can be used.

The bristles can be natural or manufactured artificially. The best grinding result, however, is accomplished by means of sisal fibres that are a natural product. Sisal fibres are comparatively expensive and the present invention with ready replacement of abrasive cloth is therefore of interest when those fibres are used.

Finally, the invention also lends itself for use of abrasive cloths in grinding brushes wherein loose brush modules are not used, but wherein the bristles are fixedly mounted directly in the cylinder of the grinding brush. In that case the cylinders are provided with rows of brushes, and between them rows of abrasive cloths are releasably mounted. The abrasive cloths and the cylinder are provided with complementary mechanical coupling means.

The invention claimed is:

1. A brush module for a rotating grinding brush, said brushing module comprising:

an elongate body part which at a first end forms a line of spaced blind bores and an undercut, longitudinally-extending guide which is parallel with said line of spaced blind bores, and at an opposite second end provides a coupling part for interconnection with a hub in a grinding brush, a plurality of bristles mounted in and extending away from each of the blind bores of said elongate body part, and an elongated holder with an abrasive cloth, said elongated holder including a bead which extends along said undercut, longitudinally-extending guide for connection with said elongate body part and two flaps which form a V-shape and which together press against an edge of said abrasive cloth so that said abrasive cloth will extend away from said elongate body part in parallel with said bristles.

2. The brush module according to claim 1, wherein the holder consists of metal.

3. The brush module according to claim 1, wherein the holder consists of plastic.

4. The brush module according to claim 1, including glue between the flaps of the holder to adhere the edge of the abrasive cloth.

* * * * *

UNITED STATES PATENT AND TRADEMARK OFFICE

CERTIFICATE OF CORRECTION

PATENT NO. : 7,988,540 B2
APPLICATION NO. : 12/656554
DATED : August 2, 2011
INVENTOR(S) : Nina Himmer It is certified that error appears in the above-identified patent and that said Letters Patent is hereby corrected as shown below:

Title page, please add Item (63)

In the heading,

Related U.S. Application Data

(63) Continuation of application No. 10/557,152 filed on December 14, 2005, now abandoned.

Signed and Sealed this
Eleventh Day of October, 2011

David J. Kappos

David J. Kappos
*Director of the United States Patent and Trademark Office*